United States Patent [19]

Matsumoto et al.

[11] 4,308,821

[45] Jan. 5, 1982

[54] ELECTROPHOTOGRAPHIC DEVELOPMENT APPARATUS

[75] Inventors: Fuyuhiko Matsumoto, Tokyo; Shuichi Karasawa, Kokubunji, both of Japan

[73] Assignee: Ricoh Company, Ltd., Tokyo, Japan

[21] Appl. No.: 76,308

[22] Filed: Sep. 17, 1979

[30] Foreign Application Priority Data

Sep. 22, 1978 [JP] Japan ..... 53/116882
Dec. 5, 1978 [JP] Japan ..... 53/150717

[51] Int. Cl.[3] ..... G03G 15/01
[52] U.S. Cl. ..... 118/645; 118/658
[58] Field of Search ..... 118/645, 658

[56] References Cited

U.S. PATENT DOCUMENTS

| | | | |
|---|---|---|---|
| 3,045,644 | 7/1962 | Schwertz | 118/645 |
| 4,098,228 | 7/1978 | Ruckdeschel et al. | 118/658 |
| 4,102,306 | 7/1978 | Ohta | 118/645 X |
| 4,189,224 | 2/1980 | Sakai | 118/645 X |

*Primary Examiner*—Bernard D. Pianalto
*Attorney, Agent, or Firm*—Wyatt, Gerber, Shoup, Scobey & Badie

[57] ABSTRACT

An electrophotographic development method and apparatus using two magnetic brushes for developing two-color images do not disturb or destroy a first developed image during a second development process, since a second magnetic brush contacts the surface of a latent electrostatic image bearing member more lightly than a first magnetic brush and the toner scraping force of the second magnetic brush is reduced in comparison with that of the second magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing member or by use of other methods. Further, by employing toners with different quantity of electric charge, high quality two-color images are obtained.

6 Claims, 7 Drawing Figures

ELECTROPHOTOGRAPHIC DEVELOPMENT APPARATUS

The present invention relates to an electrophotographic development method and apparatus and more particularly to an electrophotographic development method and apparatus for developing latent electrostatic images with different polarities, corresponding to two-color images on the white background, using two oppositely charged color toners.

Generally, in an image reproduction method of this sort, two latent electrostatic images with different polarities or with different potentials, are formed on a latent electrostatic image bearing member, such as a photoconductor, corresponding to two-colored images, and the two latent electrostatic images are successively developed by two developers with different colors, using two development apparatuses.

In the reproduction method, when a second development is performed, a visible image has already been formed on the latent electrostatic image bearing member by a first development. Therefore, the second development is performed so as to be superimposed on the first development.

A magnetic brush development apparatus is generally used in the above-mentioned image reproduction. In the magnetic brush development apparatus, a magnetic brush is formed on the surface of a development roller by the magnetic attraction of the development roller and the magnetic brush is moved in contact with the surface of the latent electrostatic image bearing member, whereby the electrostatic images on the latent electrostatic image bearing member are developed.

In the magnetic brush development apparatus, developer can be transported in a development section very easily. However, when a strong magnetic brush is brought into contact with a developed image, the developed image may be destroyed or scraped and the developer scraped from the developed image may contaminate the second developer.

SUMMARY OF THE INVENTION

It is therefore an object of the present invention to provide an electrophotographic development method and apparatus for developing two-color images, without disturbing or destroying a first developed image during a second development process using two magnetic brushes, so that high quality two-color images are obtained.

According to the present invention, a second development apparatus is designed in such a manner that a second magnetic brush of the second development apparatus is brought into contact with latent electrostatic images lighter in comparison with a first magnetic brush of a first development apparatus, so that the first developed image is not destroyed by the second magnetic brush, or the quantity of electric charge of a first developer for developing the first latent image is set greater than the quantity of electric charge of a second developer for developing the second latent electrostatic image, so that the first developed image is not destroyed during the second development, due to the stronger attraction of the first developed image to the surface of the latent electrostatic image bearing member.

DETAILED DESCRIPTION OF THE PREFERRED EMBODIMENTS

Figure 1:
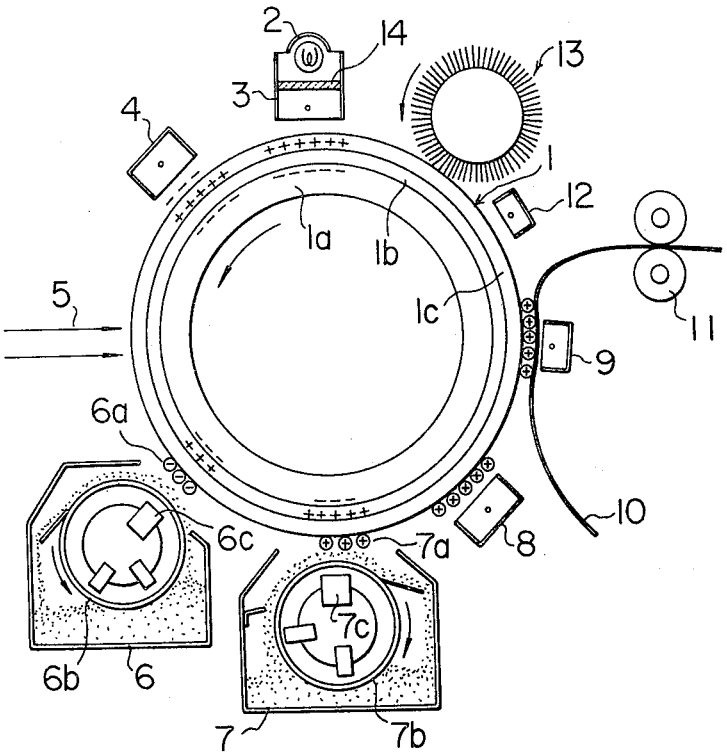
FIG. 1 is a diagrammatic view of an electrophotograhic copying apparatus to which an electrophotographic development method and apparatus of the present invention are applied.

Referring to FIG. 1, there is shown diagrammatically an electrophotographic copying apparatus capable of performing two-color copying in red and black, to which an embodiment of a development method and apparatus according to the present invention is applied.

In FIG. 1, a photoconductor drum 1 comprises an electrically conductive drum 1*a*, a first photoconductive layer 1*b* which has a panchromatic spectral sensitivity and is formed on the conductive drum 1*a*, and a second photoconductive layer 1*c* which has a spectral sensitivity with respect to red only and is formed on the first photoconductive layer 1*b*. Around the photoconductive drum 1, there are arranged a first charger 3, a second charger 4, an exposure station 5, a first magnetic brush development apparatus 6, a second magnetic brush development apparatus 7, a polarity adjustment charger 8, an image transfer charger 9, an image fixing apparatus 11, a quenching charger 12, and a cleaning apparatus 13. In FIG. 1, reference numeral 2 represents a light source disposed in the first charger 3 and reference numeral 14 a red filter.

The photoconductor drum 1 is rotated counterclockwise and is subjected to a first charging by the first charger 3, while illuminated through the red filter by the light source 2, so that the surface potential of the photoconductor drum 1 is made positive in polarity. Then a second charging, whose polarity is opposite to that of the first charging, is performed by the second charger 4, so that the surface potential of the photoconductor drum 1 is reversed to a negative polarity.

A light image of an original with red and black images on the white background is projected to the surface of the photoconductor drum 1 charged in the above-mentioned manner.

The surface potential of a red image projected portion of the photoconductor drum 1 is reversed back to positive polarity, while the surface potential of a black image projected portion remains negative in polarity, since light from the black image does not act on the surface of the photoconductor drum 1. As a result, on the surface of the photoconductor drum 1, there are formed a positive latent electrostatic image which corresponds to the red image, and a negative latent electrostatic image which corresponds to the black image. This process is disclosed in U.S. patent application Ser. No. 912,273 filed June 5, 1978, U.S. Pat. No. 4,250,239.

In the first magnetic brush development apparatus 6, a negatively charged red toner 6*a* is placed, while in the second magnetic brush development apparatus 7, a positively charged black toner 7*a* is placed, and the positive latent electrostatic image which corresponds to the red image is developed by the red toner 6*a* and the negative latent electrostatic image which corresponds to the black image is developed by the positively charged black toner 7*a*. Since the red toner 6*a* and the black toner 7*a* deposited on the surface of the photoconductor drum 1 are respectively charged to the opposite polarities, the two toners 6*a* and 7*a* are charged to one and the same polarity, namely negative or positive, by the polarity adjustment charger 8 prior to image transfer, and the toner images are then transferred to a transfer paper 10 by the image transfer charger 9. After image transfer, the transfer paper 10 is separated from the surface of the photoconductor drum 1 and is transported into the image fixing apparatus 11, where the two colored toner images are fixed to the transfer paper 10. Residual charges on the surface of the photoconductor drum 1 are quenched by the quenching charger 12 and residual toner particles on the surface of the photoconductor drum 1 are then removed by the cleaning apparatus 13.

Any conventional magnetic brush development apparatus can be employed as the magnetic brush type development apparatuses 6 and 7. In each of the development apparatuses 6 and 7, a magnetic brush is formed on a non-magnetic development sleeve with internally disposed magnets, with toner forming to the magnetic brush. The development sleeve is rotated, while the internally disposed magnets are held stationary, whereby the magnetic brush is brought into contact with the surface of the photoconductor drum 1 and development is performed.

A primary object of the present invention is that a first toner image developed by the first development apparatus 6 is not destroyed or scraped by a magnetic brush of the second development apparatus 7 so that the first toner image and a second toner image developed by the second development apparatus are developed equally.

There are several important factors which are concerned with the above-mentioned object, for example, the respective rotating directions and speeds of the first development sleeve 6*b* and the second development sleeve 7*b* relative to the rotating direction and speed of the photoconductor 1, the magnetic flux density in the first development apparatus 6 relative to the magnetic flux density in the second development apparatus 7, the gap between the surface of the photoconductor drum 1 and the surface of each of the development sleeves 6*b* and 7*b*, the properties of the first developer and the second developer including the electric charges of the respective toners, and the developer concentrations and toner concentrations in the first development apparatus 6 and the second development apparatus 7.

This is because by suitably setting at least one of the above-mentioned factors, the above-mentioned object can be attained.

In a first method according to the present invention for attaining the above-mentioned object, it is accomplished to bring a magnetic brush formed on the second development sleeve 7*b* into contact with the surface of the photoconductor drum 1 more softly than a magnetic brush on the first development sleeve 6*b* contacts the surface of the photoconductor drum 1, by setting the respective rotating directions of the first development sleeve 6*b* and the second development sleeve 7*b* relative to the rotating direction of the photoconductor drum 1 in the following manner, so that the first toner image is protected during the second development.

In the first method, the development sleeve 6*b* of the first development apparatus 6 is rotated in the same rotating direction as that of the photoconductor drum 1, that is, in the counterclockwise direction as shown by the respective arrows in FIG. 1, so that the respective peripheral surfaces of the development sleeve 6 and the photoconductor drum 1 are moved in the opposite directions in a portion where they come most closely to each other.

On the other hand, the development sleeve 7*b* of the second development apparatus 7 is rotated in the opposite direction to the rotation of the photoconductor drum 1, namely in the clockwise direction, so that the respective peripheral surfaces of the development sleeve 7*b* and the photoconductor drum 1 are moved in the same direction in a portion where they come most closely to each other. When the photoconductor drum 1 and the development sleeves 6*b* and 7*b* are arranged in this manner, the magnetic brush on the development sleeve 7*b* comes to contact with the surface of the photoconductor drum 1 more softly than the magnetic brush of the development sleeve 6*b* does, because the second magnetic brush comes to contact with the surface of the photoconductor drum 1, moving in the same direction as that of the peripheral surface of the photoconductor drum 1, while the first magnetic brush comes to contact with the surface of the photoconductor drum 1 against the movement direction of the peripheral surface of the photoconductor drum 1. It is possible to move the second magnetic brush at the same speed as that of the peripheral surface of the photoconductor drum 1.

Therefore, in the first method, the second magnetic brush comes to contact with the surface of the photoconductor drum 1 very weakly or more softly than the first magnetic brush does, whereby the second toner image is developed by the second magnetic brush without the first toner image being destroyed by the second magnetic brush.

In a second method according to the present invention, the magnetic flux density on the second development sleeve 7*b* is set weaker than that on the first development sleeve 6*b*, whereby the second magnetic brush becomes softer than the first magnetic brush. In the second method, the second magnetic brush, which is softer than the first magnetic brush, prevents the first toner image from being destroyed by the second magnetic brush. The respective magnetic flux densities of the development sleeves 6*b* and 7*b* in the above-mentioned manner can be set by adjusting the magnetic strength of each of magnets 6*c* and 7*c* or by adjusting their internal positions in the respective development sleeves 6*b* and 7*b*.

In a third method according to the present invention, the distance d2 between the second development sleeve 7*b* and the surface of the photoconductor drum 1 is set greater than the distance d1 between the first development sleeve 6b and the surface of the photoconductor drum 1.

As the distance d2 between the second development sleeve 7b and the surface of the photoconductor drum 1 is increased, the second magnetic brush on the second development sleeve 7b contacts the surface of the photoconductor drum 1 more softly in comparison with the first magnetic brush on the first development sleeve 6b, whereby the first toner image is prevented from being destroyed by the second magnetic toner.

Figure 3:
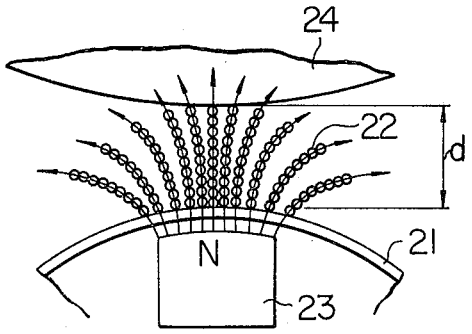
FIG. 3 is a diagrammatic view of a magnetic brush formed on the photoconductor drum of the copying apparatus of FIG. 1.

Referring to FIG. 3, this mechanism will be more clarified. In FIG. 3, developer particles 22 on a development roller 21 are linked chain-like along the lines of magnetic force of a magnet 23 disposed inside the development roller 21 so that a magnetic brush is formed. The density of the magnet brush and accordingly the density of the developer are high near the development roller 21, while the density of the magnet brush and accordingly the density of the developer are low near a latent image bearing member 24. Therefore, the greater the distance between the development roller 21 and the latent image bearing member 24, the lower the density of the magnetic brush becomes near the latent image bearing member 24. On the contrary, the smaller the distance between the development roller 21 and the latent image bearing member 24, the higher the density of the magnetic brush becomes near the latent image bearing member 24 and the stronger the scratching force of the magnetic brush.

In a fourth method, the development density on the first development sleeve 6b is made greater than the development density on the second development sleeve 7b by finishing the surface of the first development sleeve 6b and/or the surface of the second development sleeve 7b in such a manner that the surface area of the first development sleeve 6b is greater than that of the second development sleeve 7b.

In a fifth method according to the present invention, the quantity of electric charges of a unit weight of one toner is set higher than the quantity of electric charges of a unit weight of the other toner. By charging the two toners in this manner, the two toner images can be developed separately without getting any adverse effects from each other.

The above-mentioned five methods can be employed independently, with the other factors respectively set constant, or in any combination thereof.

In the following experiments, each method was checked with the other factors respectively set constant in order to grasp the effects of each method.

EXPERIMENT 1

This is an experiment of the above-mentioned first method. The experiment was conducted under the following conditions:

The photoconductor drum 1 was prepared in the following procedure: An aluminium drum was used as the electrically conductive drum 1a. On the aluminium drum, there was formed a selenium layer with a thickness of 40 μm by vacuum evaporation, while the temperature of the aluminium drum was set at 50° C., whereby the first photoconductive layer 1b was formed. A solution of the following components was then coated with the thickness of 22 μm on the selenium layer by dipping method and the coated layer was dried at 50° C. for 5 minutes, whereby the second photoconductive layer 1c was formed:

4-P-Dimethylamionpheyl-2, 6-diphenylthiopyrilium perchlorate . . . 0.1 g;

4.4'-Bis(diethylalumi)-2.2'-dimethyltriphnylmethane . . . 2.1 g;

Panlite K-1300 (Produced by Teijin Co., Ltd.) . . . 2.8 g;

Methylene chloride . . . 6.0 g.

A first developer was prepared as follows: First, a red toner was prepared by mixing one hundred parts by weight of polystyrene resin and 5 parts by weight of a pigment (CI Pigment Red 122) followed by pulverizing the mixture. Then 3 weight percent of the thus prepared red toner and 97 weight percent of oxidation processed iron powder ($Fe_3O_4$) (hereafter referred to as carrier) were mixed, whereby the first developer was prepared.

A second developer was prepared as follows: The second developer was prepared by mixing 3 weight percent of FT-2000 black toner, which is produced by Ricoh Company, Ltd., of Japan for use with FT-2500 Copying Machine of Ricoh, and 97 weight percent of the above-mentioned carrier.

The red toner was charged to negative polarity so as to have a charge of 15 μC/g, while the black toner was charged to positive polarity so as to have a charge of 15 μC/g.

The gap between the surface of the photoconductor drum 1 and the surface of each of the development sleeves 6b and 7b was set at 3.5 mm.

The magnetic flux density on the surface of the first development sleeve 6b and the magnetic flux density on the surface of the second development sleeve 7b were set at 450 Gauss.

To the first development sleeve 6b, +100 volts of bias voltage was applied, while to the second development sleeve 7b, −150 volts of bias voltage was applied.

A first charging was effected at +6.5 KV, while illuminating the surface of the photoconductor drum 1 by a 100 W tungsten lamp through R-64 filter (made by Hoya Glass Co., Ltd.) which was used as the red filter 15. Then in the dark, a second charging was effected at −5.7 KV. To the thus charged photoconductor drum 1, light images of an original containing red and black images on the white background were projected.

Figure 2:
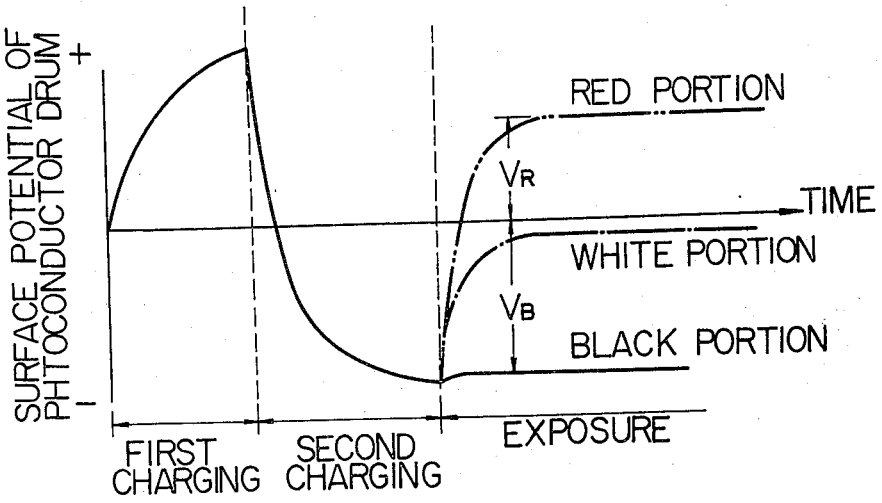
FIG. 2 shows the change of the surface potential of a photoconductor drum of the electrophotographic copying apparatus of FIG. 1 during the latent electrostatic image formation process by the copying apparatus.

As a result, the first charging potential was +1500 V and the second charging potential was −600 V, and the black image development potential $V_B^-$ was −580 V and the red image development potential $V_R^+$ was 390 V, and the potential of the white portion was −50 V. The change of the surface potential of the photoconductor drum 1 was schematically shown in FIG. 2.

Under the above-mentioned conditions, the photoconductor drum 1, the first development sleeve 6b and the second development sleeve 7b were rotated in the directions of the respective arrows as shown in FIG. 1, and the best result was obtained when the line speed of the peripheral surface of the photoconductor drum 1 was set at 180 mm/sec and the line speeds of the peripheral surfaces of the two development sleeves 6b and 7b were set at 540 mm/sec.

EXPERIMENT 2

This is an experiment of the previously mentioned second method.

In Experiment 1, the magnetic flux density on the surface of the first development sleeve 6b and the magnetic flux density on the surface of the second development sleeve 7b were changed. More specifically, the former was changed in the range from 500 to 700 Gauss, while the latter was changed from 200 to 360 Gauss. The best result was obtained when the magnetic flux density on the surface of the first development sleeve 6b was set 500 Gauss and the magnetic flux density on the surface of the second development sleeve 7b at 360 Gauss. When the magnetic flux density on the surface of the second development sleeve 7b was lower than 360 Gauss, the magnetic brush on the second development sleeve 7b became too weak for development and it was observed that the carriers deposited on the surface of the photoconductor drum 1, and when the magnetic flux density on the surface of the second development sleeve 7b was higher than 360 Gauss, the magnetic brush on the second development sleeve 7b became strong enough to scrape some of the first toner from the first toner image.

EXPERIMENT 3

This is an experiment of the previously mentioned third method.

In Experiment 1, the gap between the surface of the photoconductor drum 1 and the surface of each of the development sleeves 6b and 7b was changed.

Figure 4:
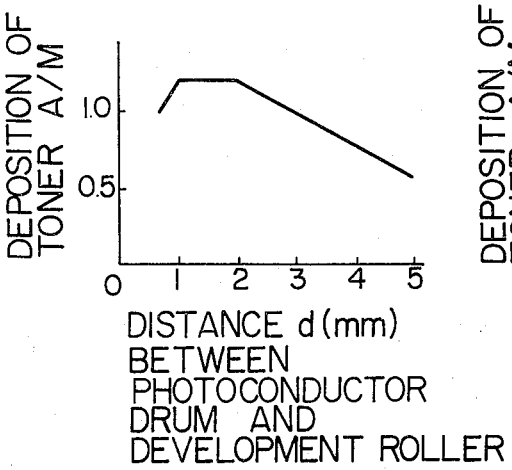
FIG. 4 shows the relationship between the deposition of toner on a first development roller and the distance between a photoconductor drum and a development roller.
Figure 5:
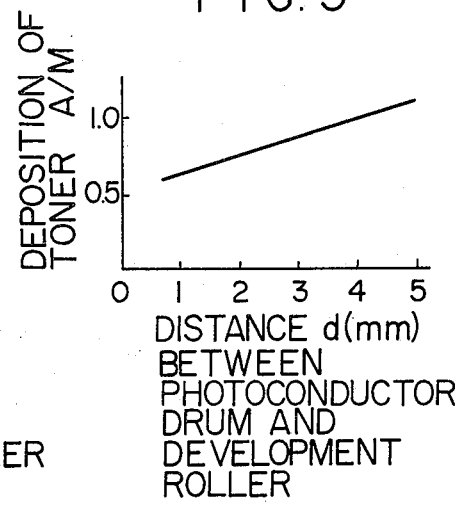
FIG. 5 shows the relationship between the deposition of toner on the first development roller and the distance between a second development roller and the photoconductor drum when a magnet brush without containing any toner is formed on the second development roller.

Prior to Experiment 3, a preliminary experiment was conducted in order to investigate the relationship between the gap between the surface of the photoconductor drum 1 and the first development sleeve 6b and the gap between the surface of the photoconductor drum 1 and the second development sleeve 7b, in the first development apparatus 6, there was placed the first developer, and in the second development apparatus 7, there was placed only the carrier, and development was performed. The results are shown in FIGS. 4 and 5. FIG. 4 shows the relationship between the deposition of toner and the distance (or gap) between the first development sleeve 6b and the surface of the photoconductor drum 1. As can be seen from FIG. 4, when the gap d was set greater than 2 mm, the deposition of the toner was reduced and accordingly, developed image density was reduced. FIG. 5 shows the relationship between the deposition of toner and the distance (or gap) between the surface of the photoconductor drum 1 and the surface of the second development sleeve 7b when only the carrier was placed in the second development apparatus 7. As can be seen from the graph of FIG. 5, when the gap was smaller than 5 mm, the toner that had deposited on the surface of the photoconductor drum 1 was scraped.

The amount of the scraped toner from the surface of the photoconductor drum 1 was reduced by increasing the gap between the surface of the photoconductor drum 1 and the second development sleeve 7b. However, when the gap was too great, the image density of the second toner image was too low. This was confirmed by Experiment 3. According to the results of Experiment 3, the best result was obtained when the gap between the surface of the photoconductor drum 1 and the surface of the first development sleeve 6b was set at 3.5 mm and the gap between the surface of the photoconductor drum 1 and the surface of the second development sleeve 7b was set at 4.0 mm.

EXPERIMENT 4

This is an experiment of the previoulsy mentioned fourth method.

Figure 6:
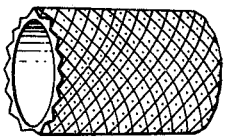
FIG. 6 is a perspective view of a non-magnetic sleeve with cross groove patterns on its surface.
Figure 7:
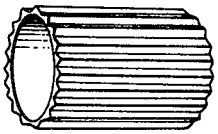
FIG. 7 is a perspective view of a non-magnetic sleeve with parallel groove patterns on its surface.

In Experiment 1, a development sleeve with cross groove patterns on its surface as shown in FIG. 6 was employed as the first development sleeve 6b and a development sleeve with parallel groove patterns on its surface as shown in FIG. 7 was employed as the second development sleeve 7b. The first development sleeve 6b has a greater surface area than the second development sleeve 7b. Using these development sleeves 6b and 7b, 5,000 copies were made. The result was that the red toner did not contaminate the developer in the second development apparatus 7 and good copies were obtained.

For comparison, the first development sleeve 6b and the second development sleeve 7b were both replaced with the development sleeves with the cross groove patterns and 3,000 copies were made. It was observed that the red toner contaminated the developer in the second development apparatus 7. Further, when only the first development sleeve 6b was replaced by the development sleeve with the parallel groove patterns on its surface, it was observed that the image density of the red toner image was reduced.

EXPERIMENT 5

This is an experiment of the previously mentioned fifth method.

In Experiment 1, instead of the second toner of FT-2000 black toner, U-Bix toner, which is a commercially available black toner, was employed.

As in Experiment 1, the red toner was charged to negative polarity so as to have a charge of 15 $\mu$C/g, while the black U-Bix toner was charged to positive polarity so as to have a charge of 8 $\mu$C/g.

The result was that a red toner image with the image density of 0.7 and a black toner image with the image density of 1.0 were obtained.

While the specific embodiments of the invention applied to a recording section of facsimile apparatus have been shown in detail to illustrate the application of the principles of the invention, it will be understood that the invention may be embodied otherwise without departing from such principles.

What is claimed is:

1. An electrophotographic development apparatus for developing electrostatic images formed on an image carrying member movable past a plurality of processing stations and having image portions of one polarity corresponding to one color of an original and image portions of the opposite polarity corresponding to another color of the original, comprising first means forming a magnetic brush of first developer having a toner of one of said colors and charged to a polarity opposite to that of said image portion corresponding to one of said colors for bringing said first developer into contact with an electrostatic image formed on said member, and second means forming a magnetic brush of second developer having a toner of the other color and charged to the polarity opposite to that of said image portion corresponding to said other color for bringing said second developer into contact with the electrostatic image after it has been contacted with said first developer, said second means bringing said second developer into contact with said image more gently than said first means brings said first developer into contact with said member to avoid abrasion by said second developer of the image portions developed by said first developer.

2. An apparatus according to claim 1, said image bearing member being rotated in a first direction, and said first and second means each including respective non-magnetic sleeves rotatable about respective magnetic cores, the sleeve of said first means rotating in a direction to move its magnetic brush across said image in a direction opposite to the movement of said image and the sleeve of said second means rotating in a direction to move its magnetic brush along said image in the same direction of movement of said image.

3. An apparatus according to claim 1, the magnetic flux density of said first means being greater than the magnetic flux density of said second means.

4. An apparatus as set forth in claim 1, said first and second means each including respective non-magnetic sleeves rotatable about respective magnetic cores, the sleeve of said second means being spaced a greater distance from said image carrying member than the sleeve of said first means.

5. An apparatus as set forth in claim 1, said first and second means each including respective non-magnetic sleeves rotatable about respective magnetic cores, the surface area of the sleeve of said first means being greater than that of the sleeve of said second means.

6. An electrophotographic development apparatus for developing electrostatic images formed on an image carrying member movable past a plurality of processing stations and having image portions of one polarity corresponding to one color of an original and image portions of the opposite polarity corresponding to another color of the original, comprising first means forming a magnetic brush of first developer having a toner of one of said colors and charged to a polarity opposite to that of said image portion corresponding to said one of said colors for bringing said first developer into contact with an electrostatic image formed on said member, and second means forming a magnetic brush of second developer having a toner of the other color and charged to the polarity opposite to that of said image portion corresponding to said other color for bringing said second developer into contact with said member after it has been contacted with said first developer, the toner of said first means having a higher charge per unit weight than the toner of said second means.

* * * * *